United States Patent [19]

Collins et al.

[11] 4,184,682

[45] Jan. 22, 1980

[54] GAME PROJECTILE

[76] Inventors: James Collins, 7710 Watson St., Philadelphia, Pa. 19111; Joseph Gerstenbacher, 2435 46th St., Pennsauken, N.J. 08110

[21] Appl. No.: 865,929

[22] Filed: Dec. 30, 1977

[51] Int. Cl.[2] ..... A63B 65/00

[52] U.S. Cl. ..... 273/106 B; 273/58 R; 273/58 K

[58] Field of Search ..... 273/106 R, 106 B, 58 R, 273/58 K, 63 EG, 26 R, 60 R; 46/74 D

[56] References Cited

U.S. PATENT DOCUMENTS

| | | | |
|---|---|---|---|
| 593,264 | 11/1897 | Walcott | 273/58 B |
| 1,404,132 | 1/1922 | Manes | 273/106 B |
| 2,362,064 | 11/1944 | Giesinger | 273/58 K |
| 3,077,051 | 2/1963 | Quinones, Jr. | 273/106 R X |
| 3,110,494 | 11/1963 | Morgan | 273/26 R |

OTHER PUBLICATIONS

Lannom Mfg. Co. Catalog, "Worth" Balls, p. 6, 1–1976.

*Primary Examiner*—Paul E. Shapiro
*Attorney, Agent, or Firm*—Morton J. Rosenberg

[57] ABSTRACT

A game projectile of unique contour adapted to be manually thrown in a plurality of trajectories. The combination of elements of the game projectile allows for minimal displacement path of the projectile subsequent to being dynamically impacted by a bat or stick member. The game projectile includes a first hemispherical contoured member which is formed of a resilient composition and is substantially symmetrical about a first vertically directed axis line. The game projectile further includes a second hemispherically contoured member having a radius less than the radius of the first hemispherically contoured member. The second hemispherically contoured member is formed in one piece formation with the first hemispherically contoured member on an external surface thereof in order to provide the pitcher with various gripping mechanisms to control the trajectory of the game projectile. In order to minimize the acceleration forces applied to the game projectile by a stick or bat member, both of the first hemispherically contoured member and the second hemispherically contoured member are formed in the hollow manner in order that great deformation may occur when dynamic impact loading occurs.

8 Claims, 4 Drawing Figures

GAME PROJECTILE

BACKGROUND OF THE INVENTION

1. Field of the Invention

This invention pertains to game like members. In particular, this invention pertains to game projectiles. Still further, this invention relates to game projectiles which are adapted to be manually thrown by a pitcher. Still further, this invention pertains to game projectiles which are adapted to be greatly deformed and reduce displacement of the projectile subsequent to being hit by a stick or b at member. More in particular, this invention relates to a game projectile which is formed of a pair of hemispherically contoured members each having a different radius dimension. Still further, this invention relates to a game projectile member which is hollow and formed of resilient wall members.

2. Prior Art

Game projectiles are well-known in the prior art. However, in general, such game projectiles which are adapted to be manually thrown by a pitcher are generally spherical in nature and formed in a closed contour. Such game projectiles are not adapted to be used in crowded conditions since impact of such balls or spherical members cause such to be driven a long distance. Thus, such prior projectiles may cause damage to personal or real property when utilized in crowded conditions, as is exemplified by large city streets.

In some prior projectiles, as exemplified in prior U.S. Pat. No. 3,099,450, the game projectiles take the form of a hemisphere. However, the interior of such projectiles is formed of a porous material such as sponge rubber. This has the unwanted effect of allowing the prior art projectile to be driven a long distance when impacted by a bat or stick. Such prior art projectiles are formed in a closed contour member and do not provide for the air to act on an internal surface of the projectile subsequent to being thrown. Thus, the amount of different trajectories which may be imparted to the projectile subsequent to being thrown is restricted. Still further, such projectiles do not provide for extension member on an external surface of the projectile. Such extension members in the form of a hemispherical element would inherently allow for added gripping stability by the pitcher, and still further allow different combinations of trajectories to be imparted to the projectile. Without such extension members, such prior art projectiles are diminished in their capacity as a game element.

Another type of prior projectile, having a hemisphere shape, is found in U.S. Pat. No. 3,416,800. Once again, this prior art projectile includes an interior formed of a porous material. Such prior art projectiles do provide for a hollowing out of a very minimal portion of the projectile on a lower surface. However, it is still formed in a closed contour shape, and provides for all of the inadequacies as has hereinbefore been described. Additionally, this reference does not provide for extension members attached to the overall hemispherically contoured element for the purposes as will hereinafter be described and detailed.

Another hemispherical type projectile is shown in U.S. Pat. No. 2,694,574 which is directed to a baseball game device. The hemispherically shaped ball is apparently provided in order that the ball will come to some rest position without the probability of the ball falling off of a game board. This reference does not address itself apparently to the hollowing out of the game projectile, nor does it provide for the extension members for gripping of the ball since such is not apparently part of this prior art game device.

SUMMARY OF THE INVENTION

A game projectile adapted to be manually thrown which includes a first hemispherically contoured member. The first hemispherical member is hollow and defines a resilient wall member having an inner surface and an outer surface. The first hemispherical member is substantially symmetrical about a first vertically directed axis line. The game projectile further includes a gripping element, which is coupled to the resilient wall member and extends external to this wall member.

DESCRIPTION OF THE PREFERRED EMBODIMENTS

Figure 1:
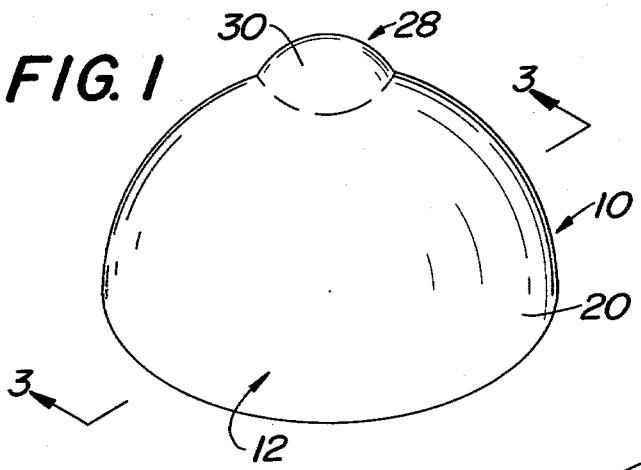
FIG. 1 is a perspective view of the game projectile taken from above.
Figure 3:
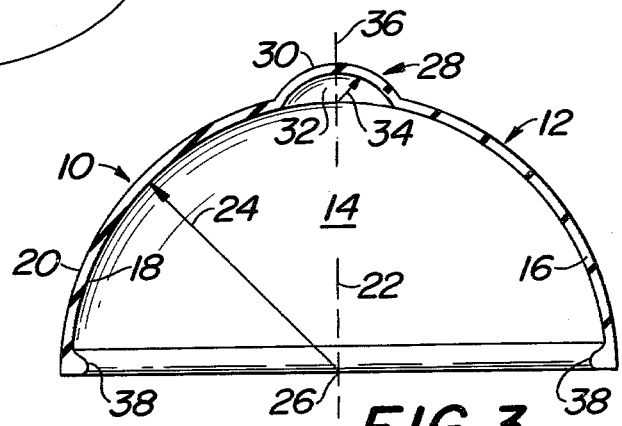
FIG. 3 is a sectional view of the game projectile taken along the section line 3—3 of FIG. 1; and, FIG. 4 is a plane view of an embodiment of the game projectile, showing grooves formed in a first hemispherical member.
Figure 2:
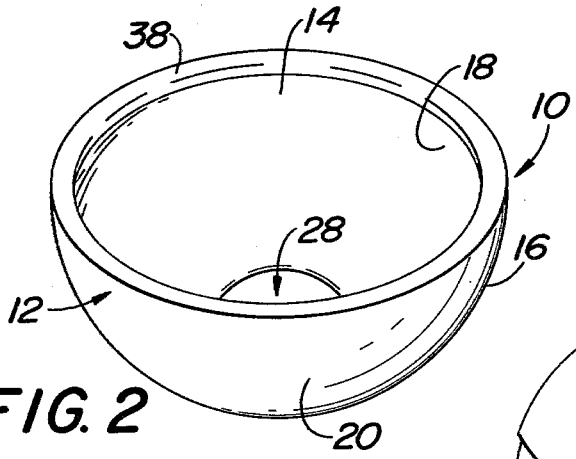
FIG. 2 is a perspective view of the game projectile taken from a lower view showing the internal portions of the game projectile.

Referring now to FIGS. 1–3, there is shown game projectile 10 to be utilized in a variety of sport-like events. Game projectile 10 is particularly adapted to be manually thrown by an operator in a number of different trajectories. In one game like situation, game projectile 10 is thrown or manually displaced by a pitcher. A batter tries to impact projectile 10 with either a bat or stick. Due to the fact that projectile 10 is very resilient and hollow, a large impact force by the batter will generally displace projectile 10 only a relatively short distance. Thus, as will be seen in following paragraphs, projectile 10 is particularly adapted for use in crowded conditions such as city streets, where users may achieve the full enjoyment of a pitching and batting game while not causing a nuisance to other people in the vicinity, or to their personal or real property.

Referring now to FIGS. 1–3, game projectile 10 which is adapted to be manually thrown from the hand of a user includes first hemispherically contoured member 12. As can be seen from FIG. 3, first hemispherical member 12 is generally dome shaped and provides for internal hollow recess 14. First hemispherical member 12 thus defines resilient wall member 16 having inner surface 18 and outer surface 20.

In overall geometrical contour, first hemispherical member 12 is generally formed substantially symmetrical about first vertically directed axis line 22 shown in FIG. 3. Additionally, hemispherical member 12 includes first radius defined by directional line 24 extending from coordinate lines central point 26 to inner surface 18. The exact dimension of radius 24 is not important to the inventive concept as is herein detailed, however, radius 24 has been found to be useful within the range of 1–1.5 inches. Member 12 has been constructed of a number of resilient materials, one of which is a vulcanized rubber material which has been found to take the high dynamic impact loading while remaining resilient over a number of uses.

It has been found extremely important that first hemispherical member 12 include hollow recess 14 as has hereinbefore been described. Hollow recess 14 permits wall member 16 to deflect substantially inward and thus to absorb the high dynamic impact loads applied by a bat or stick. This hollow recess 14 in combination with the resiliency of wall member 16 allows wall member 16 to deflect through a relatively large distance and to thus minimize the acceleration forces applied to the overall game projectile 10. In this manner, projectile 10 may be impacted with a large force yet the overall displacement of projectile 10 through the external environment is minimized.

Hollow recess 14 has been found to be important from an aerodynamic standpoint. Apparently, when projectile 10 is manually thrown, dependent upon the rotation of the throwing action about axis line 22, there has been found that the action of the air on inner surface 18 may have a distinct effect on the trajectory of projectile 10. Thus, the user, who is manually throwing projectile 10, may inherently utilize inner surface 18 to control various trajectories and possibly fool or otherwise deceive the batter into missing projectile 10 when the bat or stick is swung.

Game projectile 10 further includes gripping element 28 which is coupled to resilient wall member 16. Gripping member 28 extends external resilient wall member 16 as is shown in FIGS. 1 and 3. Gripping member 28 includes second hemispherically contoured member 30. Second hemispherical member 30 is hollow as defined by recess 32 shown in FIG. 3. Second hemispherical member 30 includes the second radius dimension defined by second radius directional arrow 34. Of importance, is that second radius dimension of second hemispherical member 30 is substantially less than first radius dimension of first hemispherical member 12.

As can be seen in FIG. 3, second hemispherical member 30 is substantially symmetrical about second vertically directed axis line 36. Additionally, second vertically directed axis line 36 of second member 30 is substantially coincident with first vertically directed axis line 22 of first member 12. In this manner, second member 30 may be easily gripped by the user about the forefinger or the index finger or some combination thereof, to provide stability in the pitching motion. Still further, the manner in which second member 30 is rotated during the trajectory of game projectile 10, determines various trajectories which may be imparted to projectile 10 by the pitcher. Thus, it can be seen that the two major functions of gripping member 28 as defined by second hemispherical member 30 is to: (1) provide stability criteria for the pitcher during the pitching motion; and, (2) to provide predetermined trajectories for projectile 10 in order that the pitcher maintain control of projectile 10 subsequent to leaving his or her hands.

Second radius dimension defined by the extension of second radius direction arrow 34 may be formed in a variety of dimensions, however, one range which has been found useful is between 0.125"-0.5". Additionally, second hemispherical member 30 may be formed of a resilient material such as vulcanized rubber or some like composition. Second hemispherical member 30 and first hemispherical member 12 are generally formed in one piece formation through molding or some like technique. Thus, in optimized form, game projectile 10 is formed of a plurality of elements coupled each to the other in a continuous manner.

Game projectile 10 further includes reinforcement element 38 shown in FIGS. 2 and 3. Reinforcement element 28 is secured to resilient wall member 16 at a lower surface thereof. Reinforcement element 38 extends inwardly within hollow recess 14 in continuous fashion about first vertically directed axis line 22 in a continuous fashion in a plane substantially normal to axis line 22. Reinforcement element 38 essentially forms a flange which is secured to resilient wall member 16 in one piece formation. The flange or rim element 38 has been found necessary due to the fact that the lower edges of first hemispherical member 12 have a tendency to crack or otherwise rip when impacted over a period of time. Rim or flange element 38 defining the reinforcement mechanism of game projectile 10 may be formed of the same material as resilient wall member 16 and in fact may be molded in continuous relation therewith. It has been found that an extension dimension internal to hollow recess 14 from inner surface 18 in the order of 1/32" is sufficient to provide reinforcement for dynamic impact loads over a substantial interval of time of usage of projectile 10. Additionally, it is noted that resilient wall member 16 may have a variety of thicknesses generally dependent on the resiliency of the material being used. However, when vulcanized rubber is provided, the wall thickness of resilient wall member 16 has been found to be useful in the range between 1/16"-¼".

Figure 4:
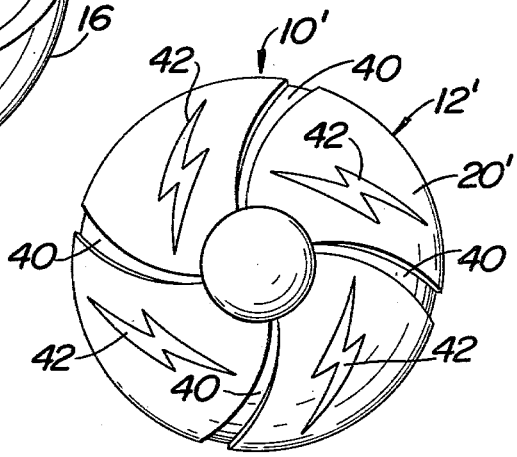

Referring now to FIG. 4, there is shown an embodiment of game projectile 10 which provides for first hemispherical member 12' in combination with gripping member 28' to provide game projectile 10'. The general dimensions and positioning of first hemispherical member 12' and gripping member 28' are similar to the formation and composition as provided in FIGS. 1–3. However, game projectile 10' shown in FIG. 4, is further provided with grooves 40 formed within outer surface 20'. As can be seen, grooves 40 extend from a peripheral boundary of gripping member 28' in a substantially helical downwardly directed contour. Grooves 40 provide additional trajectory paths, which may be imparted to game projectile 10'. Still further, grooves 40 have been utilized in additional gripping manipulations used by the pitcher in order to hide game projectile 10' from the batter or otherwise deceive the batter. As can be seen in FIG. 4, game projectile 10' may include various indicia 42 which provide for a pleasing visual effect on the surface of first hemispherical member 12'.

It is to be understood that other modifications may be resorted to without departing from the spirit or scope of the invention. Equivalent elemental structures may be substituted for those specifically shown and described, certain features may be used independently of other features, and in some cases, portions or elements may be reversed, all without departing from the spirit or the scope of the invention. It is to be understood that the invention is therefore only limited by the claims appended hereto.

What is claimed is:

1. A game projectile adapted to be manually thrown, comprising:

(a) a first hemispherically contoured member, said first hemispherical member being hollow defining a continuous resilient wall member having an inner surface and an outer surface, said first hemispherical member substantially symmetrical about a first vertical directed axis line, said first hemispherically contoured member having an internal radius within an approximate range between 1.0-1.5 inches, said first hemispherical member including at least one groove formed in said wall member within said outer surface, said groove for providing a plurality of trajectory paths to be imparted to said game projectile, said groove extending from a peripheral wall of said second hemispherical member in a helical contour; and, (b) gripping means coupled to said wall member, said gripping extending external said wall member, said gripping means including a second hemispherically contoured member, said second hemispherical member being substantially hollow.

2. The game projectile as recited in claim 1 where said first hemispherical member includes a first radius dimension and said second hemispherical member includes a second radius dimension, said second radius dimension being substantially less than said first radius dimension.

3. The game projectile as recited in claim 1 where said second hemispherical member is substantially symmetrical about a second axis line, said first and second axis lines being substantially coincident each with respect to the other.

4. The game projectile as recited in claim 1 where said second hemispherical member and said first hemispherical members are formed in one piece formation.

5. The game projectile as recited in claim 1 including reinforcement means secured to said first hemispherical wall member, said reinforcement means extending inwardly of said inner surface in continuous fashion in a plane substantially normal said first vertically directed axis line.

6. The game projectile as recited in claim 5 where said reinforcement means includes a flange member secured to said first hemispherical wall member in one piece formation.

7. The game projectile as recited in claim 1 where said first and second hemispherical members are formed of rubber.

8. A game projectile adapted to be manually thrown, comprising:

(a) a first hemispherically contoured member, said first hemispherical member being hollow defining a resilient wall member having an inner surface and an outer surface, said first hemispherical member being substantially symmetrical about a first vertically directed axis line, said first hemispherical member including at least one groove formed in said wall member within said outer surface, said groove for providing a plurality of trajectory paths to be imparted to said game projectile, said groove extending from a peripheral wall of said second hemispherical member in a helical contour; and (b) gripping means coupled to said wall member, said gripping external said wall member, said gripping means including a second hemispherically contoured member, said second hemispherical member being substantially hollow.

* * * * *